US005779527A

United States Patent [19]

Maebashi

[11] Patent Number: 5,779,527

[45] Date of Patent: Jul. 14, 1998

[54] STONE BEVELLING MACHINE

[75] Inventor: Tooru Maebashi, Fukuchiyama, Japan

[73] Assignee: Maebashi Industries Co., Ltd., Kyoto, Japan

[21] Appl. No.: 718,432

[22] PCT Filed: Mar. 22, 1996

[86] PCT No.: PCT/JP95/00551

§ 371 Date: Sep. 30, 1996

§ 102(e) Date: Sep. 30, 1996

[87] PCT Pub. No.: WO95/26863

PCT Pub. Date: Oct. 12, 1995

[30] Foreign Application Priority Data

Apr. 1, 1994 [JP] Japan ..... 6/005116 U
Jul. 22, 1994 [JP] Japan ..... 6/192009

[51] Int. Cl.[6] ..... B24B 31/00; B24B 31/02

[52] U.S. Cl. ..... 451/328; 451/326; 241/79.3

[58] Field of Search ..... 241/70, 79.2, 79.3, 241/171, 172, 176, 178, 183; 451/326, 328

[56] References Cited

FOREIGN PATENT DOCUMENTS 1-198306 8/1989 Japan .
3-38148 4/1991 Japan .

OTHER PUBLICATIONS

Form PCT/ISA/210 for PCT/JP95/00551.

*Primary Examiner*—Timothy V. Eley
*Attorney, Agent, or Firm*—Finnegan, Henderson, Farabow, Garrett & Dunner, L.L.P.

[57] ABSTRACT

A stone bevelling machine serves to round corners of bevelling stone. The machine comprises: a cylinder 2 rotating, and having a charge port on one end and a discharge port on the other end; a partition 3 separating the space within the cylinder 2 into a charge port side zone 2a and a discharge port side zone 2b, having a size-regulator gate 32 that selectively allows stones of the specified diameter or smaller to pass through the partition 3; and feeder vanes 24 being fixed at least to the inner wall of the charge port side zone 2a and protruding inward. During rotation, stone is cleared of corners thereof to be rounded when small stone, stone powder and stone chips pass through the size-regulator gate 32, so that the processing is enhanced in efficiency. If a trommel 9 is linked to the discharge port of the cylinder 2, it becomes possible to select stone or the like having passed through the discharge port.

10 Claims, 10 Drawing Sheets

STONE BEVELLING MACHINE

TECHNICAL FIELD

This invention relates to a stone bevelling machine, which, specifically, rounds the corners of stone to, for example, process the stone in such a way as to make it appear natural.

BACKGROUND ART

Popular conventional stone bevelling machines have protruding vanes facing toward the center of and attached to the inner walls of either a polygonal or circular cylinder. Stone is loaded into the cylinder, whereupon the cylinder is made to rotate. The vanes within the cylinder scratch up the stone, causing the stone to either collide with the vanes or with other stones, bevelling the corners by either breaking (chipping) or chafing the stone.

As the above mentioned type of bevelling machine processes stones, however, the stone chips and powder are retained within the cylinder during the process, creating a kind of cushion that absorbs and weakens the impact between the stones and the vanes or other stones. The longer a bevelling operation is carried out, the lower the processing efficiency becomes, rendering processing time unpredictable. Productivity is further lowered, because additional work is required to separate the stones from the chips and powder after bevelling.

The object of this invention is to resolve the above mentioned problems, by offering a stone bevelling machine that improves and stabilizes processing efficiency and makes possible excellent productivity.

SUMMARY OF THE INVENTION

To achieve the object of this invention, the bevelling machine of this invention has vanes mounted inside a rotating polygonal cylinder and has a charge port on one side and a discharge port on the other side, with a size-regulator gate located between these two ports.

More specifically the invention provides a bevelling machine equipped with a cylinder, a partition, and feeder vanes. The cylinder of the bevelling machine has a charge port on one end and a discharge port on the other end. The partition separates the space within the cylinder into a charge port side zone and a discharge port side zone and has a size-regulator gate that selectively allows only stones of a specified diameter or smaller to pass through the partition. There are a multiplicity of feeder vanes fixed at least to inner walls of the charge port side zone, protruding inwardly.

DETAILED DESCRIPTION OF THE INVENTION

Figure 1A:
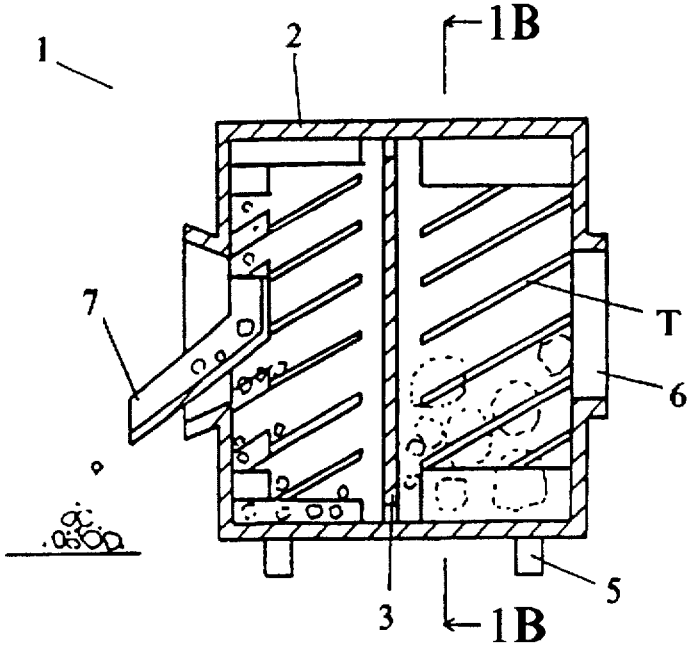
FIGS. 1A and 1B show an embodiment of the stone bevelling machine of this invention, with FIG. 1A being a vertical cross-section along the rotational axis and FIG. 1B being a cross-sectional view taken along the line 1B—1B of FIG. 1A.
Figure 1B:
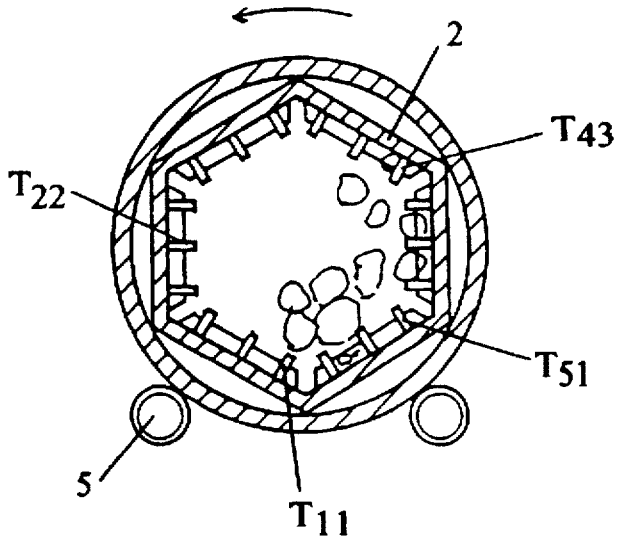

The operation of this invention will be explained in conjunction with FIGS. 1A and B. FIGS. 1A and 1B show a stone bevelling machine of this invention as a model, with 1A being a vertical cross-section along the rotational axis and (B) being a cross-section along the line 1B—1B of FIG. 1A.

In FIGS. 1A and B, the stone bevelling machine 1 is comprised of the hexagonal cylinder 2 rotated by a drive source (not shown in the diagram); a partition 3; feeder vanes T, which are fixed to the inner hexagonal shaped walls of cylinder 2 such that they protrude inward; support rollers 5, which support the cylinder and rotate along with the cylinder; charge port 6, which is located on one end of the cylinder; and discharge port 7, which is located on the other end of the cylinder. The feeder vanes T are arranged parallel to one another, diagonally with respect to both the rotational axis and a plane perpendicular to the rotational axis.

For the sake of convenience, a random one of the six internal surfaces of the hexagonal cylinder shall be referred to as surface n (n=1–6). The 'm' th feeder vane arranged on surface n, starting from the charge port, will be referred to as feeder vane Tnm.

When stones are loaded into the charge port side zone of the cylinder and the cylinder begins to rotate, the stones are regulated by feeder vane T11 and proceed to tumble in an angular direction with respect to the rotational axis. When the stones reach the end of vane T11 on the partition side, they are transferred to surface 2, and as control of the stones is also transferred, in turn, from vane T11 to vane T22, the stones proceed to tumble in the same direction as described above. The corners of the stones are rounded, as they collide either with one another or with the feeder vanes and inner walls of the cylinder.

The stone chips and powder produced as the corners and edges of the stones are rounded receive the effect of feeder vane action more strongly than stone bodies do, thereby regulated and transferred by the feeder vanes until they reach the size-regulator gates located where the partition and the walls of the cylinder meet. Stone chips and powder, as well as any stones that have dimensions equal to or smaller than the gates in the partition, pass through the gates and enter the discharge port side zone, where they leave the cylinder through a discharge port. Stones larger than the gate openings remain in the charge port side zone, where they continue to be broken down and size-regulated. The stones in the charge port side zone gradually become uniform in size, with only narrow deviation. The quantity of mixed-in stone chips and powder are few, and therefore do not form any kind of cushion in the charge port side zone, enabling continuous, high-efficiency bevelling.

The surface of the partition on the charge port side is ideally convex, in the shape of a cone, pyramid, or other similar shape, such that the convex side faces the charge port. Scratch vanes are ideally arranged, protruding from the surface of the partition and facing the charge port such that they form a radial pattern. This is a good arrangement because even if the stones still have not been broken down to the appropriate size after making a single run from the first feeder vane T11 until the last feeder vane Tnm, those stones are scratched up before reaching feeder vane Tnm and returned to the feeder vanes midway between the first and last feeder vanes, where the action of the feeder vanes, as described above, can continue to work on the stones. There is no danger that large stones will block the size-regulator gates, because before the larger stones can reach the size-regulator gates, they are returned toward the charge port by either coming in contact with the scratch vanes or the conical surface of the partition.

There will normally be stones of various sizes mixed together within the cylinder, so they may not all necessarily be transferred through the bevelling machine from one feeder vane to the next, in exact order, but will most likely be repeatedly broken down, size-regulated, and returned back mid-way up the feeder vanes, as necessary.

Many different methods exist whereby rotational drive can be conveyed to the cylinder. One good example is to form a circumferential surface of circular cylinder and assemble a sprocket or pulley approximately in the center of the circumferential surface, in axial direction, then place support rollers touching the circumferential surface in such a way as to support the cylinder. A chain or belt is fit onto the sprocket or pulley and when that chain or belt is driven by the cylinder motor installed externally to the cylinder, rotational drive is conveyed to the cylinder.

Arranging the bevelling machine in this way eliminates the necessity of having a bearing at each end of the cylinder and makes it easier to form the charge and discharge ports.

An actual embodiment of the stone bevelling machine of this invention will be explained with reference to FIGS. 2–10.

Figure 2:
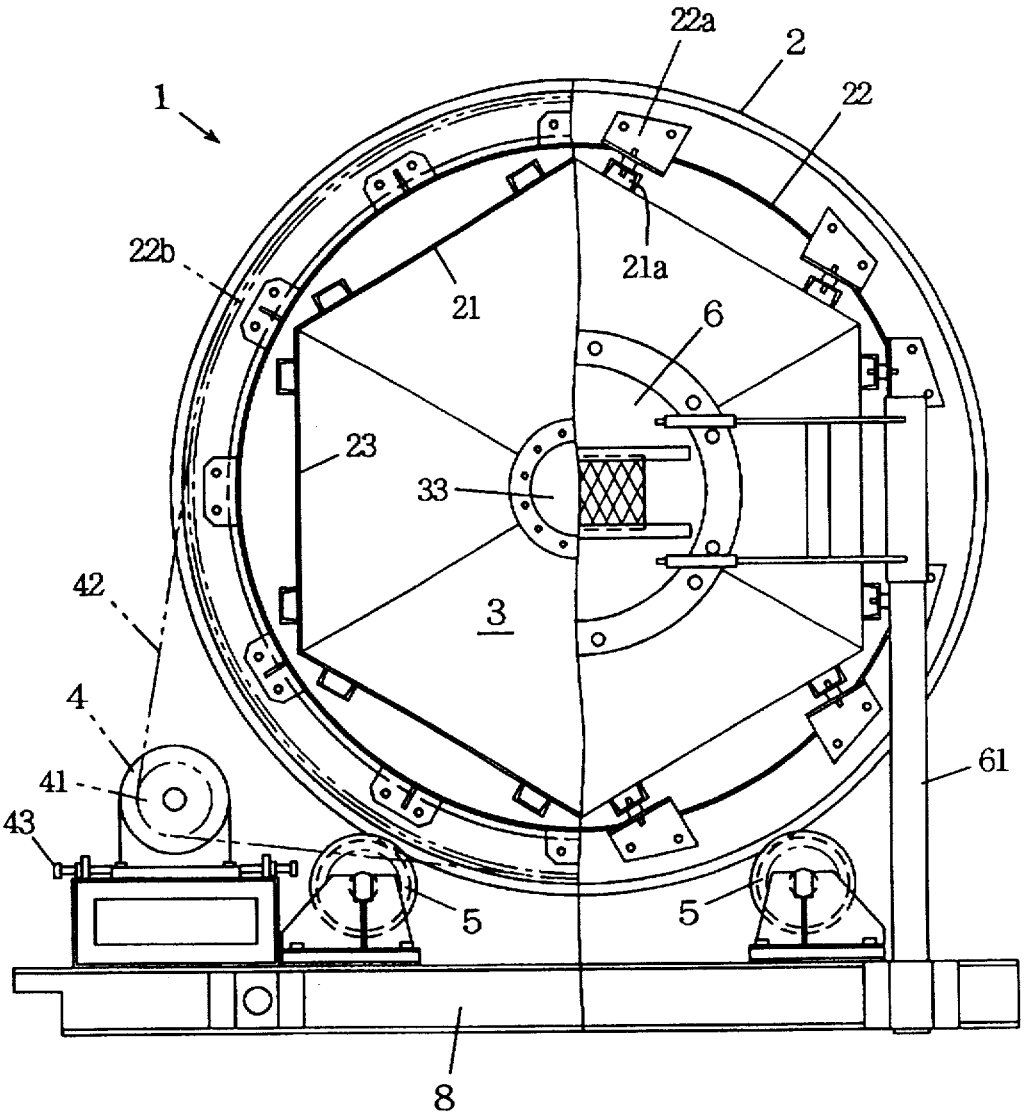
FIG. 2 is a partially broken front view of an embodiment of the bevelling machine of this invention.
Figure 3:
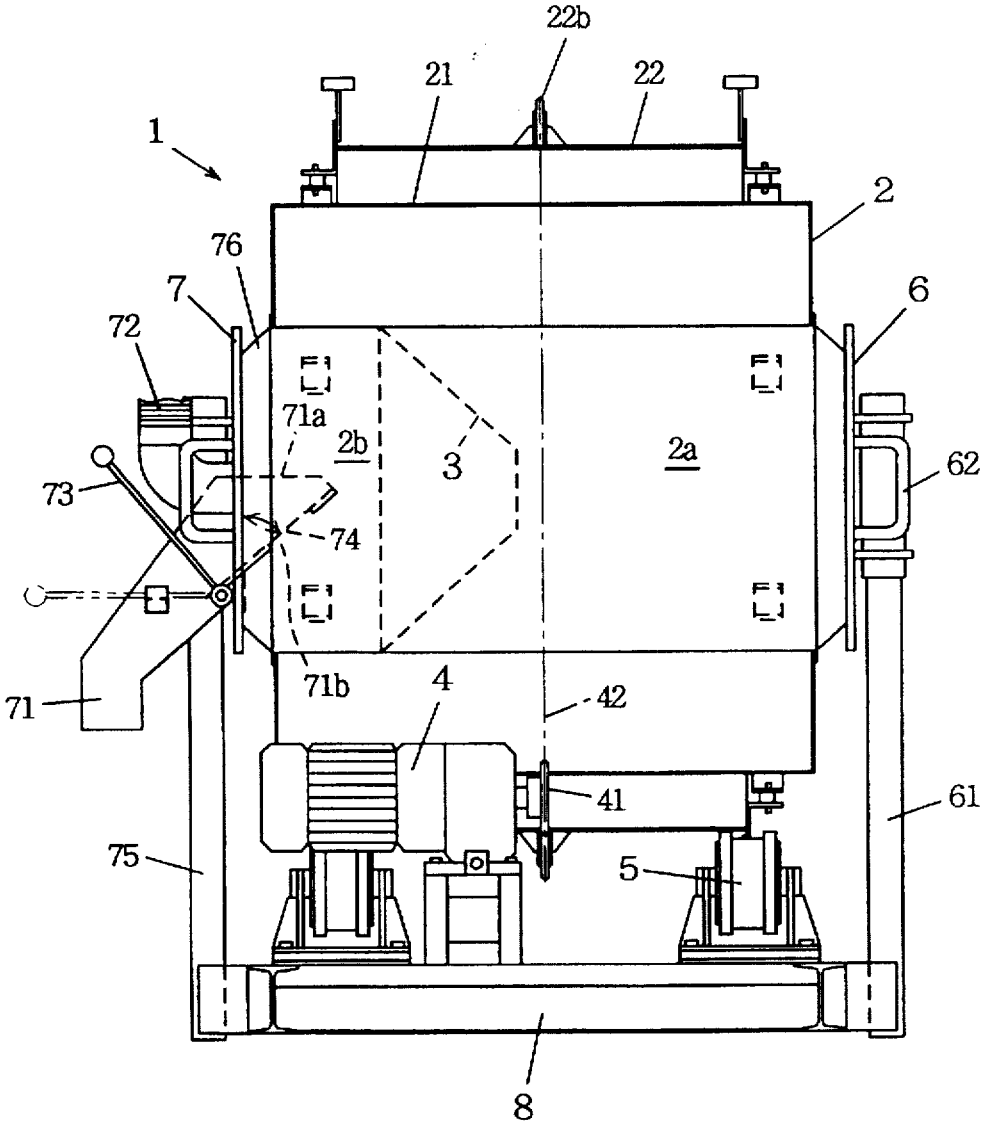
FIG. 3 is a side view from the left side of the machine of FIG. 2.

As shown in FIG. 2, stone bevelling machine 1 is equipped with a cylinder 2 having a charge port on one end; a discharge port on the other end, which rotates; a partition 3, which separates the cylinder 2 into two parts; a motor 4, which supplies the drive to rotate the cylinder 2 and is installed externally to the cylinder 2; support rollers 5, which support the cylinder 2 on the left and right sides of both the front and back of the cylinder 2; a support column 61, which stands adjacent to the charge port side end of the cylinder 2; a charge-port door 6, which is linked to the support column 61 and can be opened and closed around the column 61 used as a pivot; a handle 62 fixed on the door 6; a support column 75, which stands adjacent to the discharge port side end of the cylinder 2; a discharge-port door 7, which is linked to the support column 75 and can be opened and closed around the column 75 used as a pivot; a handle fixed on the door 7; and an installation platform 8, on which the support rollers 5 and motor 4 are fixed.

The cylinder 2 has a double drum structure, which is comprised of the inner drum 21 having a hexagonal cross-section, a diagonal length of 1,500 mm, and an axial length of 1,300 mm; and a cylindrical outer drum 22 enclosing the inner drum 21. The two drums are joined together with bolts at flanges 21*a* and 22*a*.

Means are provided for rotating the drum comprising, approximately in the center of the circumferential surface of the outer drum 22 in the axial direction, a sprocket or pulley 22*b*. A chain or belt 42 is fit onto sprocket or pulley 22*b* and a sprocket or pulley 41 of the motor 4, enabling the torque from the motor 4 to be transmitted to the cylinder 2. Minutely turning the positioning screw 43 for the motor 4 slightly moves the motor 4 closer to or farther from the cylinder 2, enabling the tension of the chain or belt 42 to be adjusted.

Figure 4A:
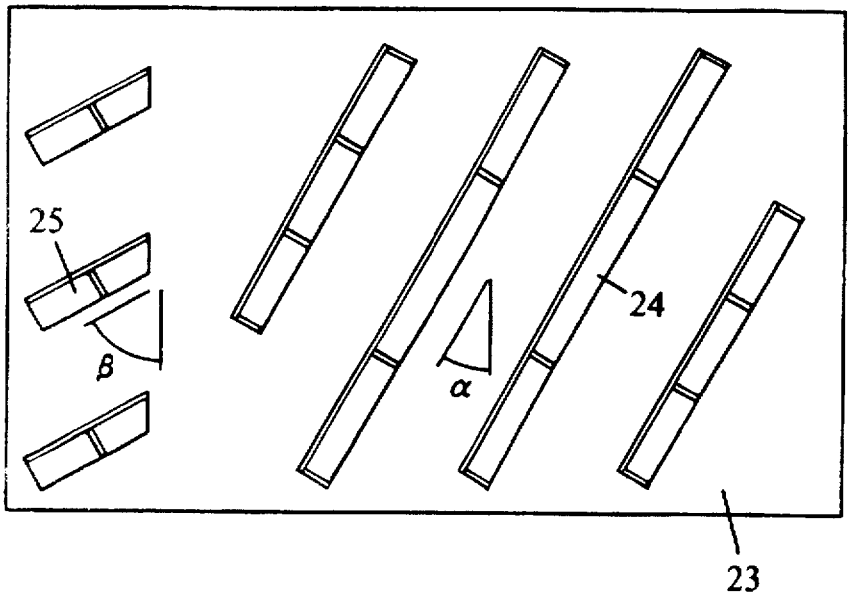
FIGS. 4A and B show the liners that are structural components of the cylinder of the machine of FIG. 2, with FIG. 4A being a front view and FIG. 4B a right-side view.
Figure 4B:
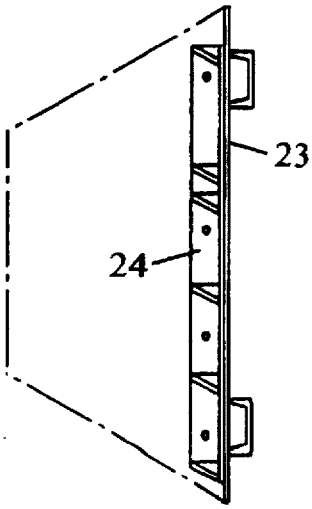
Figure 5:
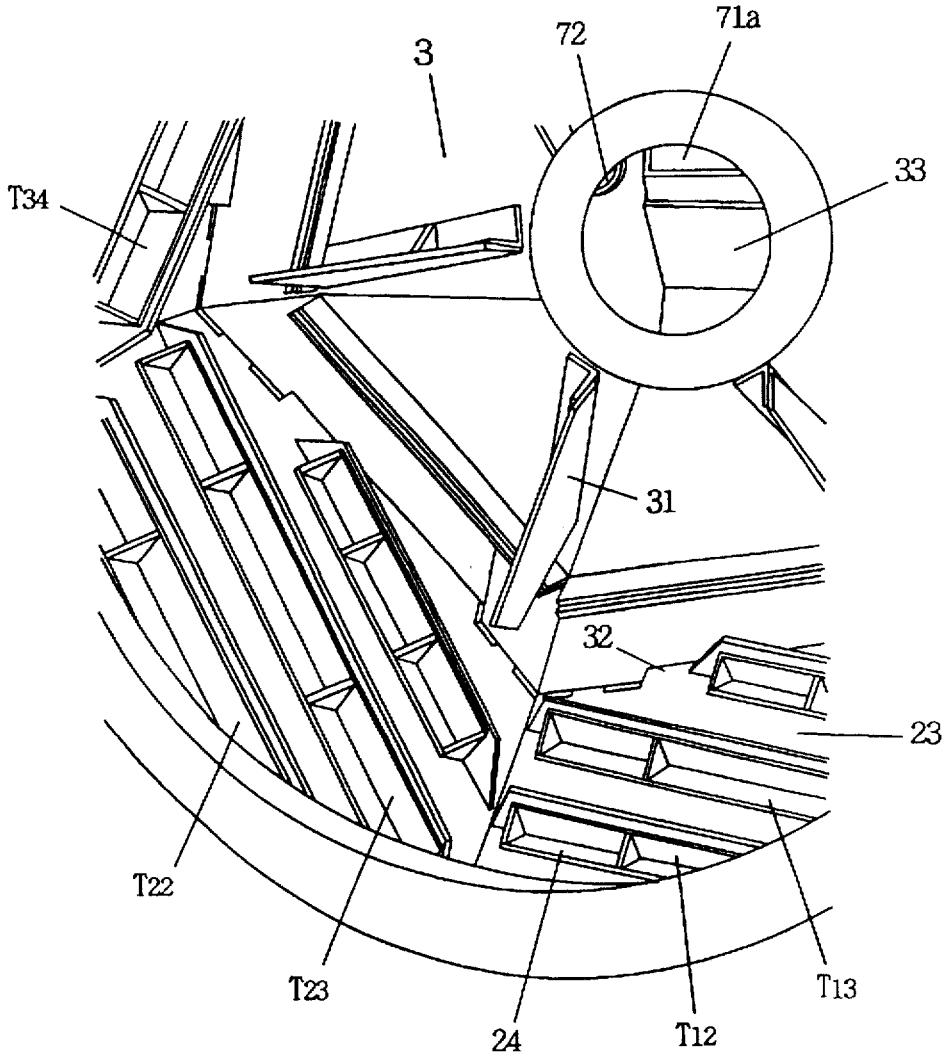
FIG. 5 is a partial diagonal view of the inner part of the machine of FIG. 2, when the charge-port door has been opened.

The surface of the inner drum 21 is formed by assembling the six liners 23, with four feeder vanes 24 on the charge port side and three feeder vanes 25 on the discharge port side, fixed in place perpendicular to the principal plane of the liners 23, as shown in FIGS. 4A and B. As shown in FIG. 5, when the liners 23 are combined to form the surface of the inner drum, a total of 42 feeder vanes 24 and 25 protrude toward the inside of the inner drum 21. The angles of the charge port side feeder vanes 24 and the discharge port side feeder vanes 25 are different from each other, but both groups of feeder vanes 24 and 25 are respectively arranged at a slanted angle with regard to the rotational axis of the cylinder 2. The angle $\alpha$ of incline of the feeder vanes 24 on the charge port side is 30° and the angle $\beta$ of incline of the feeder vanes 25 on the discharge port side is 60°.

Figure 6A:
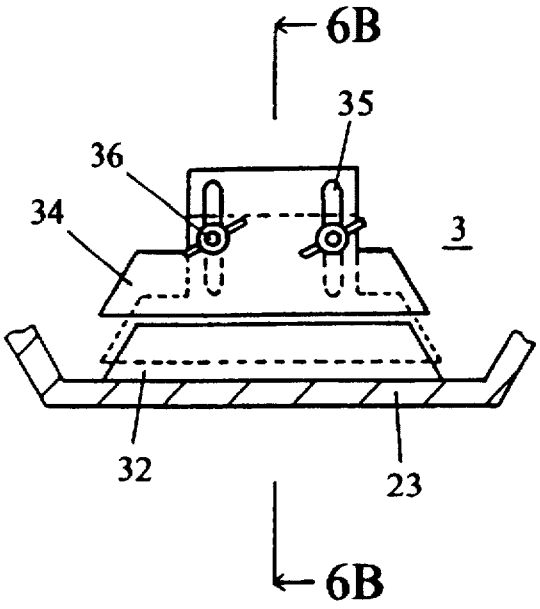
FIGS. 6A and B show the size-regulator gate in the partition of the machine of FIG. 2, with FIG. 6A being a front view and FIG. 6B a cross-sectional view taken along the line 6B—6B of FIG. 6A.
Figure 6B:
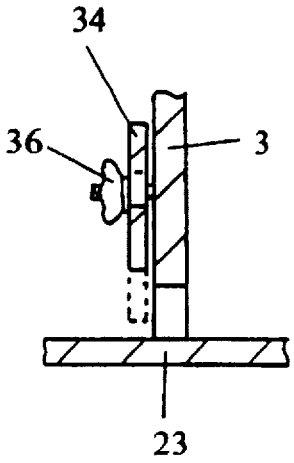

The partition 3 is made in a hexagonal, conical shape and is fixed inside the inner drum 21, such that the convex surface of the partition 3 is facing the charge port side of the cylinder 2 and the center line is aligned with the rotational axis of the cylinder 2. The partition 3 divides the inside of the cylinder 2 into a charge port side zone 2*a* and a discharge port side zone 2*b*. As shown in FIG. 5, the partition 3 is equipped with scratch vanes 31, size-regulator gates 32, and inspection window 33. The scratch vanes 31 are located along each of the radial-shaped edge parts of the convex surface, and are protruding toward the charge port. The size-regulator gates 32, are located along the border between the convex surface and the surface of the inner wall (the principal plane of the liners 23) of the inner drum 21, and selectively allow only stones of a specified diameter or less to pass through. The inspection window 33 is located in the center of the partition 3, and allows the zone on the opposite side to be viewed from either the charge port or the discharge port. Each size-regulator gate 32, as shown in FIGS. 6A and B, is comprised of adjuster plate 34 and screws 36. The adjuster plate 34 slides in the direction of the diameter, with respect to the body of the partition 3. The screws 36 pass through a long hole 35 formed in the adjuster plate 34 and join the adjuster plate 34 to the body of the partition 3. The structure of each size-regulator gate is such that the adjuster plate 34 is able to be fixed in a location where the gap is of the appropriate size.

The discharge port door 7 has a chute 71 and a duct 72. The chute 71 runs through from the inside to the outside approximately in the center of the discharge port door 7. The duct 72 also runs through the discharge port door 7 toward a suction pump (not shown in the diagram). The chute 71 has a full open port 71*a* on the top of upper end portion closer to the cylinder 2 and a partial open port 71*b* on the bottom of upper portion. Moving the handle 73 enables the opening and closing of the damper 74, which is fixed to the edge of port 71*b* such that it can swing back and forth. When the port 71*b* is open, the chute 71 is closed, blocking the passage between inside and outside. When the port 71*b* is closed, the chute 71 allows passage between the inside and outside. This means that when the handle 73 is in the upper position, as indicated by the solid line in FIG. 3, the port 71*b* is closed and stones can be discharged from the bevelling machine through the chute 71 that links the inside to the outside. Conversely, when the handle 73 is in the lower position, as indicated by the double dotted line in FIG. 3, the damper 74 swings in the direction indicated by the arrow, blocking the passage through the chute 71, opening the port 71*b*, and preventing the accumulation of stones in the chute 71.

The following will explain how the stone bevelling machine 1 works. For the sake of convenience, a random one of the six internal surfaces (the principal planes of the liners 23) of the inner drum 21 shall be referred to as surface n (n=1–6). The 'm' th feeder vane 24 arranged on surface n, starting from the charge port, will be referred to as feeder vane Tnm.

The charge port door 6 is opened and stones are loaded into the bevelling machine 1. The charge port door 6 is then closed. When the power is turned on for the motor 4, driving the chain 42, the cylinder 2 rotates, supported by the support rollers 5, while the stones remain where they were loaded in the charge port side zone 2*a*. First, the stones proceed in a direction forming a 60° angle relative to the rotational axis, as they are regulated by feeder vane T11. When the stones reach the end of feeder vane T11 on partition 3 side, they are transferred to surface 23, where they again proceed in a direction that forms 60° angle relative to the rotational axis, as being regulated by a succeeding feeder vane T22. In this way, the stones are orderly transferred from feeder vane Tnm to feeder vane Tn+1 m+1. During the process, when the surface n which is contacting with a stone approaches the top, the stone falls due to its own dead weight to surface n+1 or surface n+2, colliding with each other, the feeder vanes, and the inner walls. This action chips away at the corners of the stones, giving them a rounder appearance.

The stone chips and powder that result from the above action receive the effect of the action of the feeder vanes 24 more strongly than the stone bodies do, thereby regulated and transferred by the feeder vanes 24, eventually reaching the size-regulator gates 32 that are located where the partition 3 and the cylinder 2 meet. At the size-regulator gates 32, the stone chips and powder, as well as any stones that are equal to or smaller than the gap in the size-regulator gates 32, pass through the size-regulator gates 32 and enter the discharge port side zone 2*b*. Stones larger than the size-regulator gates 32 remain in the charge port side zone 2*a*, where they continue to be broken down and their size regulated. In this way, the stones in the charge port side zone 2*a* become uniform in size, with a narrow size distribution. The bevelling action is very efficient, because the quantity of mixed-in stone chips or powder are few, and therefore no cushion effect is generated in the charge port side zone 2*a*.

The partition 3 is a hexagonal cone, with its convex surface on the charge port side of the cylinder. The partition 3 has scratch vanes 31, which are located along each edge in a radial pattern and protrude toward the charge port. Therefore, even if the stones have not been broken down to the appropriate size after making a single run that starts with the first feeder vane T11 and ends with the last feeder vane Tnm; those stones are returned by the scratch vanes 31 to the feeder vanes 24 located mid-way back toward the charge port, then being scratched all the way back, before they reach the final feeder vane Tnm. At this point, the stones are once again subject to the action of the feeder vanes 24, described above. There is no danger that large stones will block the size-regulator gate 32, because they are returned by the scratch vanes 31 or by the conical surface of the partition 3, before they reach the size-regulator gates 32. This eliminates the time and trouble required to roughly break larger stones into smaller pieces as a preparation for loading.

As described above, there are also feeder vanes 25 located on the surfaces of the inner walls in the discharge port side zone 2*b*. If the handle 73 is lowered to close the chute 71 with the damper 74, the stones that have passed through the size-regulator gates will remain in the discharge port side zone 2*b* and be further broken down. There is a port 71*b* formed at the bottom of the chute 71, preventing the chute from becoming clogged. If it is not necessary to continue breaking down the stones in the discharge port side zone 2*b*, the handle 73 should be lifted up to close the port 71*b* with the damper 74, and open the chute 71, so that the stones are continuously discharged outside the bevelling machine, falling out from port 71*a*, as the cylinder 2 rotates. In either case, the stone dust is expelled through the duct 72, so there is no need for concern about stone dust being scattered around outside the bevelling machine.

Figure 7A:
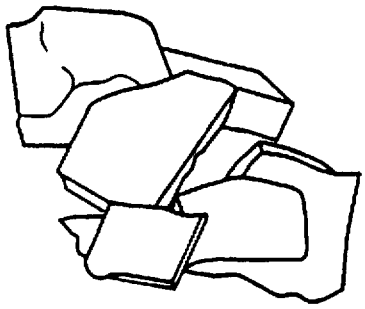
FIGS. 7A, 7B and 7C are diagrams showing stones prior to and after processing with the bevelling machine of this invention.
Figure 7B:
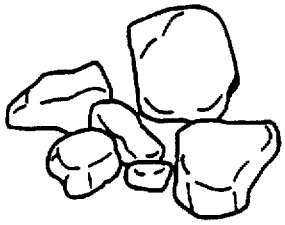
Figure 7C:
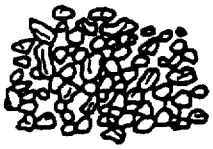

To confirm the workings of the bevelling machine 1 described in this Example, stones of sizes ranging from 50–100 mm×100–200 mm×100–200 mm, as shown in FIG. 7 (A), were loaded into the bevelling machine 1. When the stones were taken out from the charge port side zone 2*a* and the discharge port side zone 2*b*, after the cylinder had been made to rotate for some time, the stones taken from the charge port side zone 2*a* measured 50–100 mm in side, per side, and their corners were rounded, as shown in FIG. 7(B), while the stones removed from the discharge port 2*b*, were stones smaller than 50 mm, stone chips, and stone powder, as shown in FIG. 7 (C).

This bevelling machine 1 can be also used for a crusher machine. In this case, the stones from the discharge port side zone 2*b* will be the final products.

Figure 8:
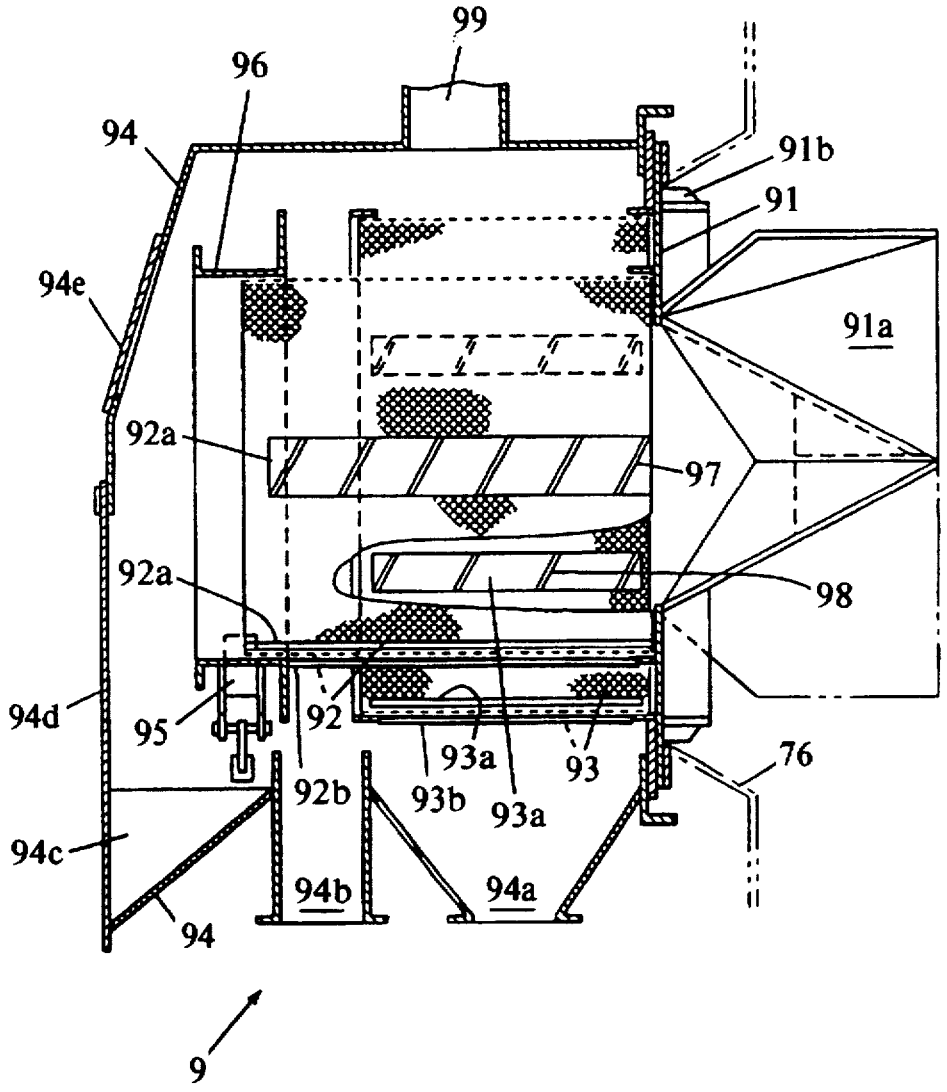
FIG. 8 is an axial sectional drawing showing a trommel that has been applied to the bevelling machine of this invention.
Figure 9:
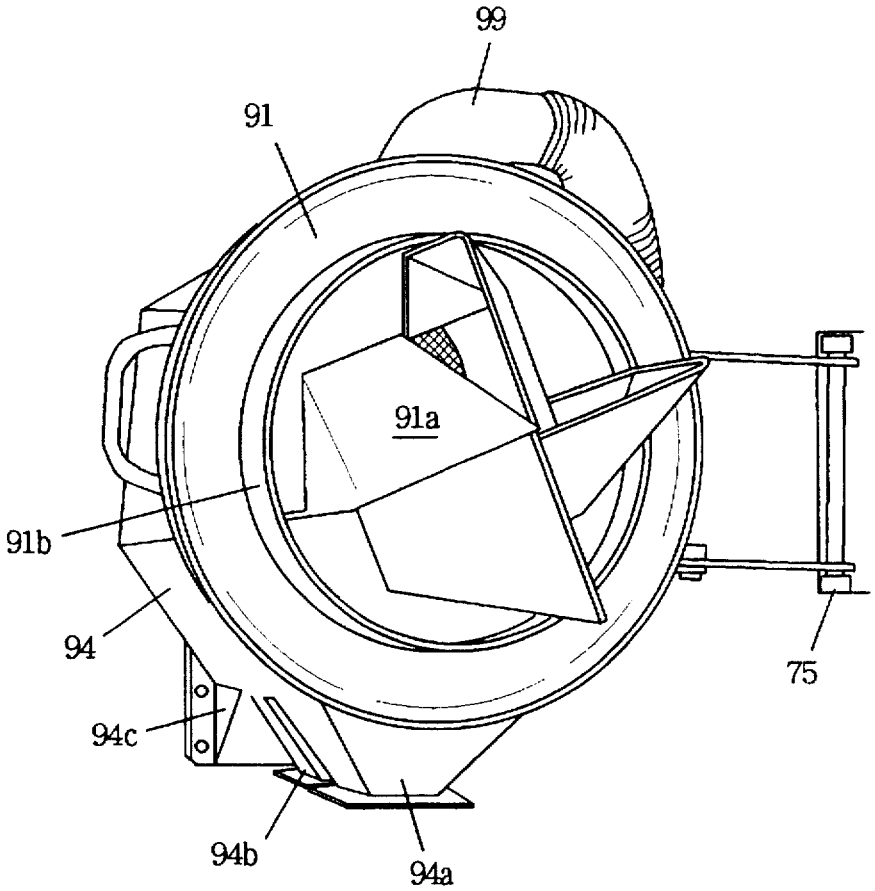
FIG. 9 is a diagonal view of the trommel of FIG. 8 as viewed from the right side.
Figure 10:
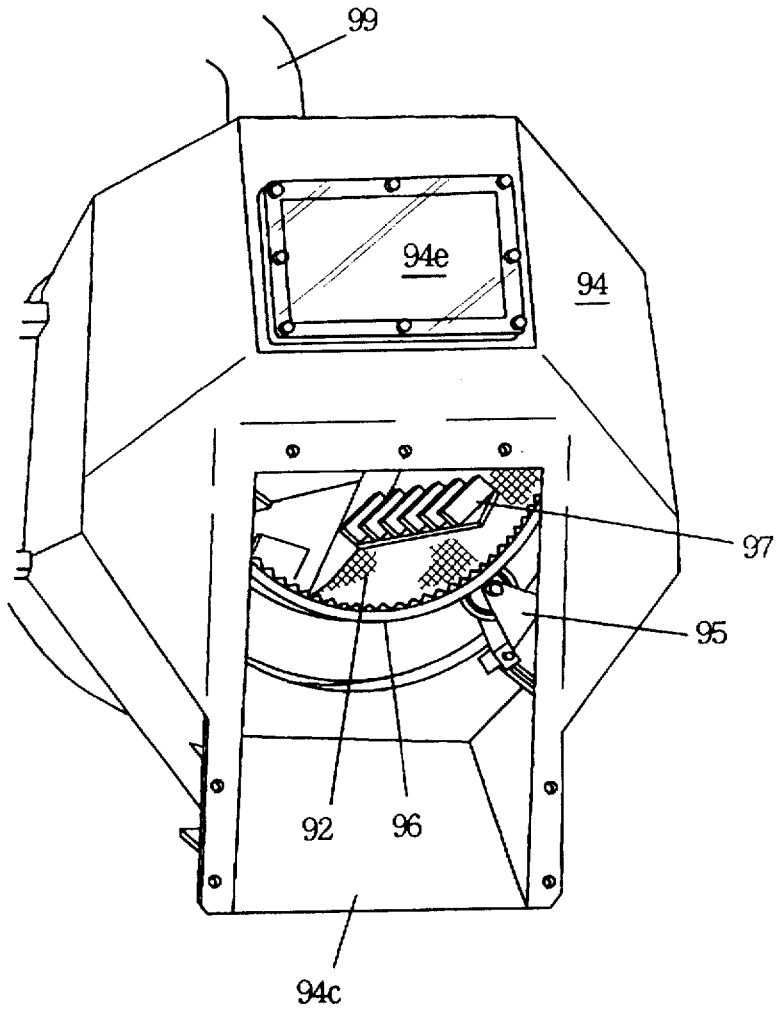
FIG. 10 is a diagonal view of the trommel of FIG. 8 as viewed from the left side.

A further embodiment of the invention is shown in FIGS. 8–10 which is the same as the bevelling machine described above, but is linked to a trommel, which enables further sorting of the bevelled stones.

The bevelling machine of this embodiment is the same as the bevelling machine described above, except that the discharge port side door 7, and its attachments; chute 71, duct 72, handle 73 and damper 74 have been removed, and instead of them, an open-and-closable trommel 9 has been attached. The trommel 9 is linked to the support column 75 and uses support column 75 as its pivot.

The trommel 9 is comprised of a foundation 91, which has a propeller 91*a* that rotates along with the cylinder 2; a cylindrical inner sieve 92, which is fixed perpendicularly to the principal plane of the foundation 91 on the opposite side of which the propeller 91*a* is installed; a cylindrical outer sieve 93, which is fixed in such a way as to enclose the inner sieve 92 within it; a cover 94, which is fixed to the support column 75 and encloses both the inner and outer sieves 92 and 93 within it; and two support rollers 95, which are fixed to the cover 94 and support the inner sieve 92. The mesh of the outer sieve 93 is narrower than that of the inner sieve 92.

The inner sieve 92 is sandwiched between multiple inner frames 92*a*, and outer frames 92*b*, which face each other. In the same way, the outer sieve 93 is sandwiched between multiple inner frames 93*a* and outer frames 93*b*. Each of the inner and outer frames are welded onto the principal plane of the foundation 91, such that both sieves 92 and 93 are fixed to the foundation 91. The inner sieve 92 extends farther than outer sieve 93 in the axial direction, along with its inner and outer frames 92*a* and 92*b*. A circular rail 96 is welded onto the outer circumference of the end of the outer frame 92*b*. This circular rail 96 contacts the support rollers 95. Multiple feeder vanes 97 are welded onto the inner frames 92*a* such that they protrude in toward the center of the inner sieve 92. In the same way, multiple feeder vanes 98 are welded onto the inner frame 93*a*.

A circular flange 91*b* is installed on the outer circumference of the principal plane on propeller 91*a* side of the foundation 91. This flange 91*b* is supported by brackets 76 protruding in a tapered shape from the discharge port of the cylinder 2.

The cover 94 has two discharge ports 94*a* and 94*b* on the bottom and one discharge port 94*c* on the farther end from the The cover 94 has two discharge ports 94*a* and 94*b* on the bottom and one discharge port 94*c* on the farther end from the foundation 91. The discharge port 94*c* is covered by a rubber lid 94*d*. On top of the cover 94, a duct 99 is installed. An observation window 94*e*, made of clear plastic, is attached between the rubber lid 94*d* and the duct 99. The rubber lid 94*d* has been removed from FIG. 10 for clarity.

Excluding the cover 94 and the support rollers 95, approximately one-half of the weight of all the components of the trommel 9 is supported by the brackets 76, via the flange 91*b*. The remaining half of the weight of the trommel 9 is supported by the support rollers 95, via the rail 96. This means that the frictional force that is proportional to the weight supported by the brackets 76, works between the brackets 76 and the flange 91*b*, so that all of the components of the trommel 9, except the cover 94 and the support rollers 95, rotate along with the rotation of the cylinder 2.

When the stone bevelling machine using the trommel is put into operation, the size of the gap in size-regulator gates 32 has been previously set larger than that when the trommel is not used. When the bevelling machine is operated, among the stones rounded within the inner drum 21, the relatively smaller size stones pass through the size-regulator gate 32 with the stone powder and enter the discharge port side zone 2*b*. These stones and powder are then taken in by the propeller 91*a* to be transferred into the trommel 9.

The trommel 9 rotates along with the rotation of the cylinder 2, so the stones and powder that are transferred into the trommel 9 are guided by the feeder vanes 97 and proceed, as they are turning around in the inner sieve 92. Stones that are larger than the mesh of the inner sieve 92 ultimately fall from the end of the inner sieve 92 and are to be discharged from the discharge port 94*c*. The rubber lid 94*d* is covering the discharge port 94*c*, so there is no danger of the stones flying out of the bevelling machine when they fall. Stones and stone powder that are smaller than the mesh of the inner sieve 92 pass through the inner sieve 92 while they are turning around and arrive on the surface of the outer sieve 93. There, the stones are guided by the feeder vanes 98 and again turn around and proceed, where they ultimately fall from the end of the outer sieve 93 and are discharged from the discharge port 94*b*. The stone powder that is smaller that the mesh of the outer sieve 93, however, passes through the outer sieve 93 while it is being moved around and is discharged from discharge port 94*a*. In this way, stones are sorted through a rotating double sieve and are then discharged from either discharge port 94*a*, 94*b*, or 94*c*, according to their size.

This stone bevelling machine enables stones to be bevelled, then sorted according to their size, all in a sequential process.

As described above, the stone bevelling machine of this invention is useful in efficiently bevelling stones and in sorting the rounded stones that are the final product, from among the stone chips.

What is claimed is:

1. A machine for bevelling stone comprising a cylinder rotatable about an axis and having an interior space, a charge port at one axial end and a discharge port at an opposite axial end;

drive means for rotating said cylinder;

a partition located between said ports and dividing the interior space of the cylinder into a charge port side zone that communicates with said charge port and a discharge port side zone that communicates with said discharge port;

a size-regulator gate in said partition that selectively allows stones of a specified size or smaller to pass through the partition from the charge port size zone to the discharge port size zone; and a plurality of feeder vanes fixed to at least an inner wall surface of the cylinder in the charge port side zone that protrude inwardly toward the axis of the cylinder for feeding stones in the charge port side zone of the cylinder from the charge port toward said partition;

wherein said partition has a convex surface facing the charge port side zone and has a plurality of scratch vanes extending in a radial pattern and protruding therefrom toward the charge port for returning larger stones received at the partition back to the feeder vanes.

2. The machine of claim 1, wherein said feeder vanes are arranged diagonally with respect to both the rotational axis and a plane perpendicular to the rotational axis.

3. The machine of claim 1, wherein said cylinder has a circular outer circumferential surface in cross-section perpendicular to the rotational axis and said drive means comprises a sprocket or pulley extending around said circumferential surface between the ends of said cylinder, a motor, a chain or belt operatively engaged between said motor and sprocket or pulley to rotate said cylinder, and a plurality of support rollers engaged with the circumferential surface to support the cylinder as it rotates about its rotational axis.

4. The machine of claim 1, wherein said cylinder has a polygonal inner wall surface to which the feeder vanes are fixed.

5. The machine of claim 4, wherein said cylinder has a hexagonal inner wall surface.

6. The machine of claim 5, wherein the convex surface on the partition forms a hexagonal cone.

7. The machine of claim 1, including feeder vanes on an inner wall surface of the cylinder in the discharge port side zone that protrude inwardly toward the axis of the cylinder for feeding stones that have passed through the size-regulator gate of the partition toward said discharge port.

8. The machine of claim 1, further comprising a trommel, linked to the discharge port of the cylinder and rotatable along with the cylinder.

9. The machine of claim 8, wherein the trommel has a rotating double sieve.

10. The machine of claim 9, wherein the trommel has a cover surrounding the rotating double sieve, the cover having discharge ports for discharging stones sorted through the rotating double sieve according to their size.

* * * * *